United States Patent [19]

Baggio et al.

[11] 4,282,075

[45] Aug. 4, 1981

[54] ELECTRODEPOSITION OF METALS

[75] Inventors: Edward G. Baggio; Clifford J. Krauss, both of Trail, Canada

[73] Assignee: Cominco Ltd., Vancouver, Canada

[21] Appl. No.: 149,960

[22] Filed: May 15, 1980

[30] Foreign Application Priority Data

Jan. 28, 1980 [CA] Canada ..... 344488

[51] Int. Cl.[3] ..... C25C 1/06; C25C 1/08; C25C 1/10; C25C 1/12

[52] U.S. Cl. ..... 204/105 R; 204/105 M; 204/106; 204/107; 204/108; 204/109; 204/110; 204/111; 204/112; 204/113; 204/114; 204/115; 204/116; 204/117; 204/118; 204/119; 204/228; 204/DIG. 7

[58] Field of Search ..... 204/DIG. 7, 228, 105–119

[56] References Cited

U.S. PATENT DOCUMENTS 3,821,097 6/1974 Ettel ..... 204/106

OTHER PUBLICATIONS

Principles of Electroplating & Electroforming by Blum et al., 3rd Ed. 1949, pp. 97–99.

*Primary Examiner*—R. L. Andrews

*Attorney, Agent, or Firm*—Wenderoth, Lind & Ponack

[57] ABSTRACT

In the electrodeposition of metals in electrowinning and electrorefining processes, the current between end electrodes in a cell is generally higher than the average current between all electrodes in the cell thereby causing warping of the end electrodes, overheating of the electrical contacts at the end electrodes and a majority of the electrical shorts to occur at these end electrodes. These problems are alleviated by controlling the current between the first two and between the last two electrodes at a value that is not greater than the average value of the current between all electrodes in the cell, by increasing the lateral spacing between the end electrodes and their immediate neighboring electrodes.

20 Claims, No Drawings

ELECTRODEPOSITION OF METALS

BACKGROUND OF THE INVENTION (a) Field of the Invention

This invention relates to improvements in the electrodeposition of metals. More particularly it relates to a method for improving the efficiency of metal electrowinning and electrorefining processes.

In electrodeposition processes for metals using anodes and cathodes, such as, for example, the electrowinning of such metals as zinc, copper, nickel, manganese, cadmium, lead and iron, and the electrorefining of such metals as copper, lead, nickel, silver, gold, bismuth and antimony, the cell commonly used is an elongated, substantially rectangular, box-like structure. The cell contains the electrolyte, and is generally provided with suitable means for ingress and egress of the electrolyte, which is generally circulated continuously. The electrodes are placed in the cell, transverse to its length, and suitably supported. They are also provided with electrical current, being connected to a power source by means of bus bars, contact bars, or other current distribution means. Generally, all of the electrodes in the cell are spaced the same distance apart, the precise spacing used being dependent upon a number of factors. With the electrodes thus equally spaced along the length of the cell, it is generally considered that the amount of current supplied to the cell is approximately equally distributed between the electrodes in the cell. In this way, an average value for the current density in the cell can be readily computed.

(b) Description of the Prior Art

The alignment of the electrodes in such electrolysis cells is of considerable importance. If the electrodes are improperly aligned, electrode warping, corrosion and shorting can all occur, resulting in prematurely short electrode life and also in a loss of current efficiency. Many means have been developed to ensure that the electrodes are both properly spaced and properly aligned. Such means are of a great variety of designs. Typical examples are to be found in the following United States patents:

U.S. Pat. No. 1,206,963, Robert L. Whitehead, 1916.

U.S. Pat. No. 1,206,964, Robert L. Whitehead, 1916.

U.S. Pat. No. 1,206,965, Robert L. Whitehead, 1916.

U.S. Pat. No. 1,276,208, Julius H. Gillis, 1918.

U.S. Pat. No. 2,115,004, William H. Bitner, April 26, 1938.

U.S. Pat. No. 2,443,112, Fernando Alfred Morin, June 8, 1948.

U.S. Pat. No. 3,579,431, Peter M. Jasberg. May 18, 1971.

U.S. Pat. No. 3,697,404, Peter M. Paige, October 10, 1972.

U.S. Pat. No. 3,997,421, Roland Perri, December 14, 1976.

U.S. Pat. No. 4,035,280, Richard Deane et al, May 12, 1977.

In these last two patents, a spool shaped notched contact-bar, and anode spacer clips are described which, when used in conjunction with suitable electrodes, provide a stable three dimensional array of anodes and cathodes in electrolytic cells.

However, even when adequate precautions are taken to ensure both proper alignment and proper spacing of electrodes, electrical difficulties are still experienced. Shorting between electrodes, overheating of electrodes, warping of electrodes and other consequent problems are encountered, which lead to losses of both current efficiency and productivity. In an extreme case, shorting can lead to localised melting of electrodes.

SUMMARY OF THE INVENTION

It has now been observed that by far the majority of electrode failures occur at the end electrodes at each end of a conventional cell, regardless of whether these electrodes are cathodes (in electroerefining) or anodes (in electrowinning). More particularly, it has been observed that the current between the end electrodes and the next adjacent electrode, regardless of whether the end electrodes are cathodes (in electrorefining) or anodes (in electrowinning) is higher than the average current between all electrodes in the cell. Further, it has been observed that the difference in the current between the end electrodes and the next adjacent electrodes and the average current between all electrodes can be considerable, ranging from 10% higher up to about 30% higher.

Because of this higher than average current, the end electrodes have a higher than average tendency to warp and short. Also, the end electrode contacts and insulators also tend to overheat when shorting occurs, as they are then carrying far more than their designed current loading. Thus this higher than average current at the end electrodes in the cell has observable effects outside the cell. The higher than average current between the electrodes of the pairs of end electrodes also causes problems in the cell. The higher than average current results in a higher than average current density at these electrodes which in turn leads to an increased occurrence of electrical shorts between the end electrodes and their immediate neighbouring electrodes. The problems then tend to become self-proliferating: these shorts not only limit electrodeposition time, but also, in a chain contact system, increase further the amount of current at the cell ends. The shorts also affect the voltage drop in the system, making it less at the ends than across the remainder of the cell, which again increases the current at the ends, thus accelerating shorting, warping, and cell efficiency loss.

We have now discovered that if the excess current, or current density, between the end electrodes is eliminated, the majority of cell end electrode shorts and failures, as much as 90% of the total, can be eliminated. Furthermore, we have also discovered that this excess current can be eliminated by the simple expedient of increasing the spacing of the end electrodes from their immediate neighbours.

DESCRIPTION OF THE PREFERRED EMBODIMENTS

Thus, this invention provides a method for the electrolytic deposition of metals using an electrolytic cell containing an electrolyte, in which a multiplicity of electrodes, consisting of alternate, substantially equally spaced anodes and cathodes, is immersed, the anodes and cathodes, respectively, independently being connected to a source of electrical power; wherein the current between at least one end electrode and its immediate neighbouring electrode is controlled at a desired value by increasing the spacing of the end electrode from its immediate neighbouring electrode to a value higher than that between the remainder of the electrodes in the cell.

Preferably, the current between both of end electrodes and their immediate neighbouring electrodes is controlled at a desired value by increasing the spacing of both end electrodes from their immediately neighbouring electrodes to a value higher than that between the remainder of the electrodes in the cell; conveniently, the increase in spacing is the same at both ends of the cell.

More preferably, the spacing of the end electrodes relative to their immediate neighbouring electrodes is increased to a value which is double the value of the spacing between the remainder of the electrodes.

In an alternative embodiment, the spacing of the end electrodes relative to their immediate neighbours is increaased until the value of the current between the end electrodes and their immediate neighbours is no greater than, and preferably is less than, the average value of the current between all the electrodes in the cell.

By this simple means it is possible to control the current, and therefore the current density, between the end electrodes to a value at which electrode failures due to warping, shorting and overheating occur no more frequently at the ends of the cell than any place else in the cell.

The increase in spacing of the end electrodes from their immediate neighbours can be accomplished in several ways. If the cell dimensions permit, the first and last electrode can be simply moved laterally away from their immediate neighbouring electrodes to provide the desired wider spacing. Alternatively, if space limitations do not permit lateral movement, the required space can be obtained by removing at least one pair of electrodes (that is, at least one anode and at least one cathode) from the array. On relocation of the array centrally in the cell, sufficient space will then be left at the cell ends to obtain the desired increased spacing. It is to be noted that reducing the number of electrodes in the cell does not necessarily result in a loss of productivity: any loss that theoretically should result from this electrode removal is generally more than off set by the actual increase in cell efficiency which is feasible with the lower number of electrodes. Generally, it will be found that the cell can be operated with a higher current density.

In most electrowinning and electrorefining plants, as was noted above, the electrode spacing and alignment is determined by the manner in which the electrodes are supported in the cell. A typical instance is the spool-like contact bar described in U.S. Pat. No. 4,035,280 mentioned previously. When apparatus of this nature is used, it ceases to be possible, without extensive modification of the contact bars, etc., to vary the spacing of the end electrodes from their immediate neighbours by small amounts. Further, such modification of the cell apparatus is, generally, not very practical or practicable. Thus the practical, and usually only, available increase that can be made is to vary the spacing between the end electrode and its immediate neighbouring electrode in multiples of the spacing unit used for the remainder of the electrodes. Thus, if the majority of the electrodes are spaced on 4.5 cm intervals, the available spacings for the end electrodes becomes 4.5 cm, 9 cm, 13.5 cm, and so on. It has been found that doubling of the spacing may result in the current between an end electrode and its neighbour being lower than the average value for the current between all the electrodes in the cell. Thus this doubling, which is largely dictated by the apparatus commonly used, represents a simple way of achieving the benefits of this invention.

This increased spacing of the end electrodes has been found to afford the following advantages, not all of which were to be expected:

1. Increased cell current efficiency.
2. Substantial reduction in the number of damaged and warped electrodes.
3. Possible increased cell electrodeposition time, leading to higher productivity.
4. Substantial reduction in damage to electrode contacts and insulators.
5. Significant reduction of the heat load of the electrolyte cooling system.
6. Some improvement in the quality, in terms of impurities, of the deposited metal.
7. Substantial reduction in the number of shorts between electrodes.

The invention will now be illustrated by way of the following nonlimitative Comparative Examples, in which cells used for the electrowinning of zinc from a zinc sulphate electrolyte were used. In these comparisons electrolyte is continuously fed to and removed from the cells in a conventional fashion. The electrodes are supported on contact bars as described in U.S. Pat. No. 4,035,280, to give a spacing unit distance between electrodes of 4.5 cm, measured between the electrode centers. The anodes were lead-silver alloy, and aluminum cathode starting sheets were used. A current of 48,000 A was supplied to each cell, and the cells operation observed for a period of six months.

EXAMPLE A.

All electrodes at same spacing

An array of 49 anodes and 48 cathodes was placed in each cell. This gives an average current per cathode face of 500 A, over the whole cell. Measurements of the actual cell currents showed that the actual current being carried by the first and last cathodes varied between 550 A and 650 A: that is from 10% to about 30% higher than the cell average. Recording of the location of all cell shorts and damaged electrodes showed over 50% to be at the two pairs of end electrodes in the cell. Analysis of the deposited zinc showed a lead content of between 20 ppm and 40 ppm, the mean being 30 ppm. Continuous addition of barium carbonate to the electrolyte at a rate of 2.3 kg/ton deposited zinc reduced the lead content to the range of 15 ppm to 20 ppm.

EXAMPLE B.

End electrodes at wider spacing

An array of 47 anodes and 46 cathodes was placed in each cell, the lower number of electrodes allowing the end anodes to be set further away from the immediately neighbouring cathodes. In this case, the spacing was doubled, so that the end electrode spacings were 9.0 cm, the remainder being 4.5 cm. This array gives an average current per cathode face of 522 A, the increase over Example A being due to the lower number of cathodes. Measurements of the actual cell currents showed that the current being carried by the first and last cathodes was 350 A, that is 30% lower than the average of 522 A for the whole cell. Recording of the location of shorts in the cells and of damaged electrodes showed a reduction of 90% in shorts and in end electrode failures: that is, end electrode failures became about 5% of all failures, thus making the failure frequency for these end electrodes roughly the same as all others, as there are nearly 100 electrodes in the cell. Analysis of the deposited zinc showed a lead content of from 10 to 15 ppm. Intermittent addition of less than 1 kg barium carbonate/ton deposited zinc was found sufficient to maintain the lead content in this range.

It is thus apparent that significant operating efficiencies result from the process of this invention.

What is claimed is:

1. A method for the electrolytic deposition of metals using an electrolytic cell containing an electrolyte in which a multiplicity of electrodes, consisting of alternate, substantially equally spaced anodes and cathodes is immersed, the anodes and cathodes, respectively, independently being connected to a source of electrical power; wherein the current between at least one end electrode and its immediate neighbouring electrode is controlled at a desired value by increasing the spacing of the end electrode from its immediate neighbouring electrode to a value higher than that between the remainder of the electrodes in the cell.

2. A method according to claim 1, in which the spacing of both end electrodes from their immediate neighbouring electrodes is increased.

3. A method according to claim 2, in which the spacing of both end electrodes from their immediate neighbouring electrodes is increased to the same value.

4. A method according to claim 1 or 3 in which the spacing of the end electrode(s) from the immediate neighbouring electrode(s) is increased to a value which is substantially double the value of the spacing between the remainder of the electrodes.

5. A method for the electrolytic deposition of metals using an electrolytic cell containing an electrolyte, in which a multiplicity of electrodes, consisting of alternate, substantially equally spaced anodes and cathodes, is immersed, the anodes and cathodes, respectively, independently being connected to a source of electrical power; wherein the current between at least one end electrode and its immediate neighbouring electrode is controlled at a value not exceeding the average value of the current between all the electrodes, in the cell, by increasing the spacing of the end electrode from its immediate neighbouring electrode to a value higher than that between the remainder of the electrodes in the cell.

6. A method according to claim 5 wherein the current between both end electrodes and their immediate neighbouring electrodes is controlled.

7. A method according to claim 6 wherein the current is controlled to substantially the same value for both end electrodes by increasing the spacing of both end electrodes by substantially the same amount.

8. A method according to claim 5 or 6 wherein the current is controlled at a value lower than the average value of the current between all the electrodes in the cell.

9. A method according to claim 5 or 6 wherein the current is controlled to a value lower than the average value of the current between all the electrodes in the cell by increasing the spacing of the end electrode(s) to a value which is substantially double the spacing between the remainder of the electrodes.

10. A method for the electrowinning of zinc using an electrolytic cell containing an acid zinc sulfate electrolyte, in which a multiplicity of alternate, substantially equally spaced anodes and cathodes is immersed, the anodes and cathodes, respectively, independently being connected to a source of electrical power; wherein the current between at least one end anode and its immediate neighbouring cathode is controlled at a desired value by increasing the spacing of the end anode from the immediate neighbouring cathode to a value higher than that between the remainder of the anodes and cathodes in the cell.

11. A method according to claim 10 in which the spacing of both end anodes from their neighbouring cathodes is increased.

12. A method according to claim 11 in which the spacing of both end anodes from their immediate neighbouring cathodes is increased to the same value.

13. A method according to claim 10 or 12 in which the spacing of the end anode(s) from the immediate neighbouring cathode(s) is increased to a value which is substantially double the value of the spacing between the remainder of the anodes and cathodes.

14. A method for the electrowinning of zinc using an electrolytic cell containing an acid zinc electrolyte, in which a multiplicity of alternate substantially equally spaced anodes and cathodes is immersed, the anodes and cathodes, respectively, independently being connected to a source of electrical power; wherein the current between at least one anode and its immediate neighbouring cathode is controlled at a value not exceeding the average value of the current between all the electrodes in the cell, by increasing the spacing of the end anode from the immediate neighbouring cathode to a value higher than that between the remainder of the anodes and cathodes in the cell.

15. A method according to claimm 14 wherein the current between both end anodes and their immediate neighbouring cathodes is controlled.

16. A method according to claim 15 wherein the current is controlled to substantially the same value for both end anodes by increasing the spacing of both end anodes by substantially the same amount.

17. A method according to claim 14 or 15 wherein the current is controlled at a value lower than the average value of the current between all the electrodes in the cell.

18. A method according to claim 14 or 15 wherein the current is controlled at a value lower than the average value of the current between all the electrodes in the cell by increasing the spacing of the anode(s) to a value which is substantially double the spacing between the remainder of the electrodes.

19. A method according to claim 1 or 5 wherein the electrodeposition process is the electrowinning of a metal chosen from copper, nickel, manganese, cadmium, lead and iron.

20. A method according to claim 1 or 5 wherein the electrodeposition process is the electrorefining of a metal chosen from copper, lead, nickel, silver, gold, bismuth and antimony.

* * * * *